US012256770B2

(12) United States Patent
Abi Aoun

(10) Patent No.: US 12,256,770 B2
(45) Date of Patent: Mar. 25, 2025

(54) METHOD OF MANUFACTURING AN AMORPHOUS SOLID COMPRISING AN AEROSOL-FORMER MATERIAL

(71) Applicant: NICOVENTURES TRADING LIMITED, London (GB)

(72) Inventor: Walid Abi Aoun, London (GB)

(73) Assignee: NICOVENTURES TRADING LIMITED, London (GB)

( * ) Notice: Subject to any disclaimer, the term of this patent is extended or adjusted under 35 U.S.C. 154(b) by 287 days.

(21) Appl. No.: 17/780,365

(22) PCT Filed: Nov. 27, 2020

(86) PCT No.: PCT/EP2020/083788
§ 371 (c)(1),
(2) Date: May 26, 2022

(87) PCT Pub. No.: WO2021/105466
PCT Pub. Date: Jun. 3, 2021

(65) Prior Publication Data

US 2023/0010782 A1 Jan. 12, 2023

(30) Foreign Application Priority Data

Nov. 29, 2019 (GB) ..... 1917473

(51) Int. Cl.

| | |
|---|---|
| ***A24C 5/01*** | (2020.01) |
| ***A24B 3/14*** | (2006.01) |
| ***A24B 15/167*** | (2020.01) |
| ***A24D 1/20*** | (2020.01) |
| ***A24F 40/20*** | (2020.01) |

(52) U.S. Cl.
CPC ..... *A24C 5/01* (2020.01); *A24B 3/14* (2013.01); *A24B 15/167* (2016.11); *A24D 1/20* (2020.01); *A24F 40/20* (2020.01)

(58) Field of Classification Search
CPC ..... A24C 5/01; A24B 15/167; A24B 3/14; A24F 40/20; A24D 1/20
See application file for complete search history.

(56) References Cited

U.S. PATENT DOCUMENTS

| | | | | |
|---|---|---|---|---|
| 5,499,636 | A | 3/1996 | Baggett, Jr. et al. | |
| 11,974,594 | B2 * | 5/2024 | Rosado | A24B 3/08 |
| 2004/0177856 | A1 | 9/2004 | Monsalud, Jr. et al. | |
| 2005/0039767 | A1 | 2/2005 | Mua et al. | |

(Continued)

FOREIGN PATENT DOCUMENTS

| | | | |
|---|---|---|---|
| CH | 691156 | A5 | 5/2001 |
| JP | 2016-506729 | A | 3/2016 |

(Continued)

OTHER PUBLICATIONS

International Search Report and Written Opinion for Application No. PCT/EP2020/083788 mailed on Mar. 1, 2021, 12 pages.

*Primary Examiner* — Gary F Paumen
(74) *Attorney, Agent, or Firm* — WOMBLE BOND DICKINSON (US) LLP

(57) ABSTRACT

A method of manufacturing an amorphous solid, the method including a) forming a slurry including a particulate botanical material, a gelling agent, and an aerosol-former material; b) forming a layer of the slurry; and c) drying the slurry to provide the amorphous solid.

15 Claims, 5 Drawing Sheets

(56) References Cited

U.S. PATENT DOCUMENTS

| | | | | |
|---|---|---|---|---|
| 2008/0078417 | A1* | 4/2008 | Wanna | A24C 5/1857 131/372 |
| 2015/0107610 | A1 | 4/2015 | Metrangolo et al. | |
| 2018/0310607 | A1* | 11/2018 | Prestia | A24B 3/14 |
| 2019/0142058 | A1* | 5/2019 | Klipfel | A24C 5/01 131/370 |
| 2020/0214335 | A1* | 7/2020 | Prestia | A24C 5/01 |

FOREIGN PATENT DOCUMENTS

| | | | | |
|---|---|---|---|---|
| JP | 2018-504127 | A | 2/2018 | |
| JP | 2019-502366 | A | 1/2019 | |
| RU | 2670766 | C9 | 12/2018 | |
| UA | 128311 | C2 | 6/2024 | |
| UA | 128622 | C2 | 9/2024 | |
| UA | 128889 | C2 | 11/2024 | |
| WO | 2013/178766 | A1 | 12/2013 | |
| WO | 2013/178768 | A1 | 12/2013 | |
| WO | 2014/048745 | A1 | 4/2014 | |
| WO | 2015/055567 | A1 | 4/2015 | |
| WO | 2016/050471 | A1 | 4/2016 | |
| WO | WO-2016184928 | A1 | 11/2016 | |
| WO | 2017/077112 | A1 | 5/2017 | |
| WO | 2017/089589 | A1 | 6/2017 | |
| WO | WO-2017089545 | A1 | 6/2017 | |
| WO | WO-2017202538 | A1 | 11/2017 | |
| WO | WO-2018037048 | A1 * | 3/2018 | A24B 15/16 |
| WO | 2020/025726 | A1 | 2/2020 | |
| WO | 2020025714 | A1 | 2/2020 | |
| WO | 2020025731 | A1 | 2/2020 | |

* cited by examiner

METHOD OF MANUFACTURING AN AMORPHOUS SOLID COMPRISING AN AEROSOL-FORMER MATERIAL

The present application is a National Phase entry of PCT Application No. PCT/EP2020/083788, filed Nov. 27, 2020, which claims priority from GB Patent Application No. 1917473.9, filed Nov. 29, 2019, which is hereby fully incorporated herein by reference.

TECHNICAL FIELD

The present invention relates to a method of manufacturing an amorphous solid and consumables for use within a non-combustible aerosol provision system comprising aerosol-generating material comprising the amorphous solid; and non-combustible aerosol provision systems.

BACKGROUND

Smoking consumables such as cigarettes, cigars and the like burn tobacco during use to create tobacco smoke. Alternatives to these types of consumables release an inhalable aerosol or vapor by releasing compounds from a substrate material by heating without burning. These may be referred to as non-combustible smoking consumables or aerosol generating assemblies.

One example of such a product is a heating device which release compounds by heating, but not burning, a solid aerosol-generating material. This solid aerosol-generating material may, in some cases, contain a botanical material. The heating volatilizes at least one component of the material, typically forming an inhalable aerosol. These products may be referred to as heat-not-burn devices, tobacco heating devices or tobacco heating products. Various different arrangements for volatilizing at least one component of the solid aerosol-generating material are known.

As another example, there are hybrid devices. These contain a liquid source (which may or may not contain nicotine) which is vaporized by heating to produce an inhalable vapor or aerosol. The device additionally contains a solid aerosol-generating material (which may or may not contain a tobacco material) and components of this material are entrained in the inhalable vapor or aerosol to produce the inhaled medium.

SUMMARY

According to a first aspect of the present invention, there is provided a method of manufacturing an amorphous solid, the method comprising:

a) forming a slurry comprising a particulate botanical material, a gelling agent and an aerosol former;
b) forming a layer of the slurry; and
c) drying the slurry to provide the amorphous solid.

The invention also provides an amorphous solid obtainable or obtained by the above method.

Also provided by the invention is an aerosol-generating material comprising an amorphous solid, wherein the amorphous solid comprises a particulate botanical material, a gelling agent and an aerosol-former, and wherein the amorphous solid is in the form of a sheet.

A further aspect of the invention is a consumable for use within a non-combustible aerosol provision system, the consumable comprising an aerosol-generating material comprising an amorphous solid, the amorphous solid comprising a particulate botanical material, a gelling agent and an aerosol-former.

The invention also provides a non-combustible aerosol provision system comprising the above consumable and a non-combustible aerosol provision device, the non-combustible aerosol provision device comprising an aerosol-generation device to generate aerosol from the consumable when the consumable is used with the non-combustible aerosol provision device.

The invention also includes the use of a consumable as described above in a non-combustible aerosol provision device, the non-combustible aerosol provision device comprising an aerosol-generation device to generate aerosol from the consumable when the consumable is used with the non-combustible aerosol provision device.

Further features and advantages of the invention will become apparent from the following description of preferred embodiments of the invention, given by way of example only, which is made with reference to the accompanying drawings.

DETAILED DESCRIPTION

Figure 1:
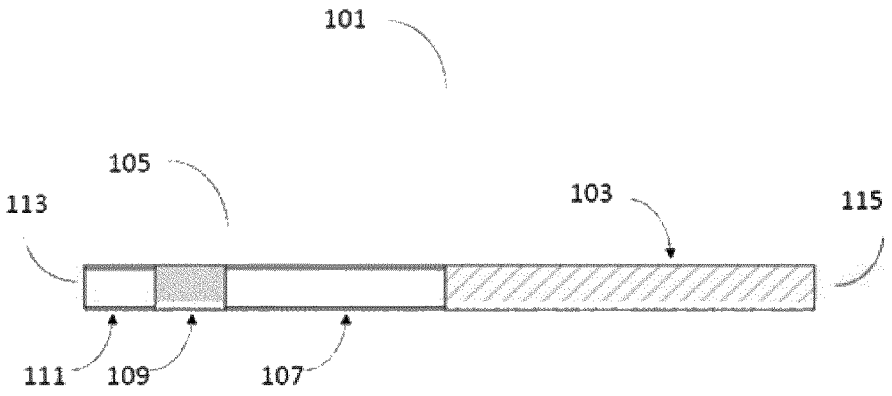
FIG. 1 shows a section view of an example of a consumable.

As noted above, the present invention provides a method of manufacturing an amorphous solid, the method comprising:

a) forming a slurry comprising a particulate botanical material, a gelling agent and an aerosol-former;
b) forming a layer of the slurry; and
c) drying the slurry to provide the amorphous solid.

The "amorphous solid" may alternatively be referred to as a "monolithic solid" (i.e. non-fibrous), or as a "dried gel". The amorphous solid is a solid material that may retain some fluid, such as liquid, within it. The amorphous solid may form part of an aerosol-generating material which comprises from 50 wt %, 60 wt % or 70 wt % of amorphous solid, to about 90 wt %, 95 wt % or 100 wt % of amorphous solid.

The amorphous solid is formed from a dried gel. The inventors have found that using these component proportions means as the gel sets, flavor compounds are stabilized within the gel matrix allowing a higher flavor loading to be achieved than in non-gel compositions. The flavoring is stabilized at high concentrations and the products have a good shelf life.

The amorphous solid is preferably formed by a casting process of the type generally comprising casting a slurry comprising particulate botanical material and one or more binders onto a conveyor belt or other support surface, drying the cast slurry to form a sheet of amorphous solid and removing the sheet of amorphous solid from the support surface. In some cases, the method comprises casting the slurry of (a) on a support movable along a transport direction. In some cases, the amorphous solid is formed into a continuous sheet.

In some embodiments, the method further comprises d) slitting the sheet of amorphous solid along the transport direction while the sheet of amorphous solid is moved along the transport direction so as to form portioned sheets of amorphous solid.

In some cases, the method further comprises winding the sheet onto a bobbin. In cases were the sheet is slit, the sheet may be wound onto two or more bobbins of smaller size.

The method of manufacturing, in some cases, comprises crimping the amorphous solid. Subsequently, in some cases, the crimped amorphous solid is gathered to form a rod, which is then circumscribed by a wrapper to form a consumable.

Hence, in an exemplary embodiment, the invention provides a method of manufacturing a consumable for use with a non-combustible aerosol provision system configured to heat, but not burn, the consumable, the method comprising:

a) forming a slurry comprising particulate botanical material, a gelling agent and an aerosol-former, b) forming a layer of the slurry; and c) drying the slurry to provide a sheet of amorphous solid;

d) crimping the sheet to form a crimped sheet; and e) gathering the crimped sheet to form a rod.

In some embodiments the slurry of a) comprises 1-60 wt % of a gelling agent;

0.1-50 wt % of an aerosol-former; and 0.1-80 wt % of an active substance comprising the particulate botanical material; the weights being calculated on a dry weight basis, and In some embodiments, the slurry of a) comprises 1-80 wt % of a flavorant calculated on a dry weight basis (DWB hereon in), wherein the flavorant comprises the particulate botanical material. In some embodiments the slurry comprises a solvent.

In some embodiments, the slurry comprises:

1-50 wt % of a gelling agent;

0.1-50 wt % of an aerosol-former; and 30-60 wt % of an active substance comprising the particulate botanical material; the weights being calculated on a dry weight basis, and a solvent.

The invention also provides a consumable for use in non-combustible aerosol provision system, the consumable comprising an aerosol-generating material containing an amorphous solid, the amorphous solid comprising particulate botanical material, a gelling agent and an aerosol-former. In certain embodiments amorphous solid in in the form of a sheet; in some such embodiments the sheet is a crimped sheet.

In some embodiments the aerosol-generating material is provided on a support to form a substrate. In such embodiments the support may be a carrier sheet. Suitably both the carrier sheet and the sheet of aerosol-generating material is crimped; however, it is also envisaged that only one sheet is crimped. Suitably, the carrier sheet and the amorphous solid form a laminate structure. In some cases, the carrier sheet and amorphous solid can be crimped in a single step, for example, by passing the laminate structure through a crimper. In some cases, the carrier sheet and amorphous solid sheet are not laminated together.

In some cases, at least one of the carrier sheets is a sheet of homogenized botanical material. In some cases, at least one of the carrier sheets is a sheet of susceptor material. In other cases, there may be a further carrier sheet; for example, one carrier sheet may comprise a homogenized botanical material and another carrier sheet may comprise a different support material described herein, for example paper, or a susceptor material such as aluminum foil. In such an embodiment a tri-laminate structure may be formed and then crimped and gathered to form a rod circumscribed by a wrapper.

In certain embodiments the sheet of amorphous solid and the at least one carrier sheet are provided on bobbins, which are unwound to layer the sheet of amorphous solid and the sheet of carrier material together.

In certain embodiments, both the sheet of amorphous solid and a carrier sheet are crimped; however, it is also envisaged that only one sheet is crimped. Suitably, a carrier sheet and an amorphous solid form a laminate structure. In some cases, the carrier sheet and amorphous solid sheet can be crimped in a single step, for example, by passing the laminate structure through a crimper. In some cases, the carrier sheet and amorphous solid sheet are not laminated together.

In certain embodiments, the amorphous solid comprises:

1-60 wt % of a gelling agent;

0.1-50 wt % of an aerosol-former; and 0.1-80 wt % of an active substance comprising particulate botanical material; wherein these weights are calculated on a dry weight basis.

In some embodiments, the amorphous solid comprises:

1-50 wt % of a gelling agent;

0.1-50 wt % of an aerosol-former; and 30-60 wt % of an active substance comprising particulate botanical material; wherein these weights are calculated on a dry weight basis.

In some embodiments the active substance comprises particulate botanical material and a flavorant. In some embodiments the flavorant is menthol. In some embodiments the particulate botanical material is particulate tobacco.

Suitably, the amorphous solid may comprise up to about 80 wt %, 70 wt %, 60 wt %, 55 wt %, 50 wt % or 45 wt % of the flavorant. In some cases, the amorphous solid may comprise at least about 0.1 wt %, 1 wt %, 10 wt %, 20 wt %, 30 wt %, 35 wt % or 40 wt % of the flavorant (all calculated on a dry weight basis). For example, the amorphous solid may comprise 1-80 wt %, 10-80 wt %, 20-70 wt %, 30-60 wt %, 35-55 wt % or 30-45 wt % of the flavorant. In some cases, the flavorant comprises, consists essentially of or consists of menthol.

Suitably the flavorant is added to slurry during the method of manufacture. In some embodiments the flavorant which is added to the slurry comprises molten menthol. Molten menthol and particulate botanical material may be present in a range of ratios between 10:1 and 1:10 the ratios representing the dry weight of molten menthol and particulate botanical material added to the slurry; for example, the molten menthol and particulate botanical material may be added in a ratio of 9:1, 8:1, 7:1, 6:1, 5:1, 4:1, 2:1, 1:1, 1:2, 1:3, 1:4, 1:5, 1:6, 1:7, 1:8, 1:9 or 1:10. In some cases, the molten menthol is omitted.

In some cases, the amorphous solid may additionally comprise an emulsifying agent, which emulsifies molten flavorant during manufacture. For example, the amorphous solid may comprise from about 5 wt % to about 15 wt % of an emulsifying agent (calculated on a dry weight basis), suitably about 10 wt %. The emulsifying agent may comprise acacia gum.

In some embodiments, the amorphous solid is a hydrogel and comprises less than about 20 wt % of water calculated on a wet weight basis. In some cases, the hydrogel may comprise less than about 15 wt %, 12 wt % or 10 wt % of water calculated on a wet weight basis (WWB). In some cases, the hydrogel may comprise at least about 1 wt %, 2 wt % or at least about 5 wt % of water (WWB).

Suitably, the amorphous solid may comprise from about 1 wt %, 5 wt %, 10 wt %, 15 wt %, 20 wt % or 25 wt % to about 60 wt %, 50 wt %, 45 wt %, 40 wt % or 35 wt % of a gelling agent (all calculated on a dry weight basis). For example, the amorphous solid may comprise 1-50 wt %, 5-45 wt %, 10-40 wt % or 20-35 wt % of a gelling agent.

In some embodiments, the gelling agent comprises a hydrocolloid. In some embodiments, the gelling agent comprises one or more compounds selected from the group comprising alginates, pectins, starches (and derivatives), celluloses (and derivatives, such as such as methylcellulose, hydroxypropyl cellulose, and carboxymethyl cellulose (CMC)), gums, silica or silicones compounds, clays, polyvinyl alcohol and combinations thereof. For example, in some embodiments, the gelling agent comprises one or more of alginates, pectins, hydroxyethyl cellulose, hydroxypropyl cellulose, carboxymethylcellulose, pullulan, xanthan gum guar gum, carrageenan, agarose, acacia gum, fumed silica, PDMS, sodium silicate, kaolin and polyvinyl alcohol. In some cases, the gelling agent comprises alginate and/or pectin, and may be combined with a setting agent (such as a calcium source) during formation of the amorphous solid. In some cases, the amorphous solid may comprise a calcium-crosslinked alginate and/or a calcium-crosslinked pectin.

In examples, the setting agent comprises or consists of calcium acetate, calcium formate, calcium carbonate, calcium hydrogencarbonate, calcium chloride, calcium lactate, or a combination thereof. In some examples, the setting agent comprises or consists of calcium formate and/or calcium lactate. In particular examples, the setting agent comprises or consists of calcium formate. The inventors have identified that, typically, employing calcium formate as a setting agent results in an amorphous solid having a greater tensile strength and greater resistance to elongation.

The gelling agent may comprise one or more compounds selected from cellulosic gelling agents, non-cellulosic gelling agents, guar gum, acacia gum and mixtures thereof.

In some embodiments, the cellulosic gelling agent is selected from the group consisting of: hydroxymethyl cellulose, hydroxyethyl cellulose, hydroxypropyl cellulose, carboxymethylcellulose (CMC), hydroxypropyl methylcellulose (HPMC), methyl cellulose, ethyl cellulose, cellulose acetate (CA), cellulose acetate butyrate (CAB), cellulose acetate propionate (CAP) and combinations thereof.

In some embodiments, the gelling agent comprises (or is) one or more of hydroxyethyl cellulose, hydroxypropyl cellulose, hydroxypropyl methylcellulose (HPMC), carboxymethylcellulose, guar gum, or acacia gum.

In some embodiments, the gelling agent comprises (or is) one or more non-cellulosic gelling agents, including, but not limited to, agar, xanthan gum, gum Arabic, guar gum, locust bean gum, pectin, carrageenan, starch, alginate, and combinations thereof. In preferred embodiments, the non-cellulose based gelling agent is alginate or agar.

In some embodiments, the gelling agent comprises alginate, and the alginate is present in the amorphous solid in an amount of from 10-30 wt % of the amorphous solid (calculated on a dry weight basis). In some embodiments, alginate is the only gelling agent present in the amorphous solid. In other embodiments, the gelling agent comprises alginate and at least one further gelling agent, such as pectin.

In some embodiments the amorphous solid may include gelling agent comprising carrageenan.

The inclusion of a gelling agent in the slurry results in the aerosol-generating material being formed from a dried gel. The inventors have found that by including a gelling agent in the amorphous solid, flavor compounds, for example, menthol and particulate tobacco, are stabilized within the gel matrix allowing a higher flavor loading to be achieved than in non-gel compositions. The flavoring (e.g. menthol or particulate tobacco) is stabilized at high concentrations and the products have a good shelf life.

Suitably, the amorphous solid may comprise from about 0.1 wt %, 0.5 wt %, 1 wt %, 3 wt %, 5 wt %, 7 wt % or 10% to about 50 wt %, 45 wt %, 40 wt %, 35 wt %, 30 wt % or 25 wt % of an aerosol-former (all calculated on a dry weight basis). The aerosol-former may act as a plasticizer. For example, the amorphous solid may comprise 0.5-40 wt %, 3-35 wt % or 10-25 wt % of an aerosol-former. In some cases, the aerosol-former comprises one or more compound selected from erythritol, propylene glycol, glycerol, triacetin, sorbitol and xylitol. In some cases, the aerosol-former comprises, consists essentially of or consists of glycerol. The inventors have established that if the content of the plasticizer is too high, the amorphous solid may absorb water resulting in a material that does not create an appropriate consumption experience in use. The inventors have established that if the plasticizer content is too low, the amorphous solid may be brittle and easily broken. The plasticizer content specified herein provides an amorphous solid flexibility which allows the sheet to be wound onto a bobbin, which is useful in manufacture of consumables of the invention.

In some embodiments, the aerosol former comprises one or more polyhydric alcohols, such as propylene glycol, triethylene glycol, 1,3-butanediol and glycerin; esters of polyhydric alcohols, such as glycerol mono-, di- or triacetate; and/or aliphatic esters of mono-, di- or polycarboxylic acids, such as dimethyl dodecanedioate and dimethyl tetradecanedioate.

In some embodiments, the amorphous solid is a hydrogel and comprises less than about 20 wt % of water calculated on a wet weight basis. In some cases, the hydrogel may comprise less than about 15 wt %, 12 wt % or 10 wt % of water calculated on a wet weight basis. In some cases, the hydrogel may comprise at least about 1 wt %, 2 wt % or at least about 5 wt % of water (WWB).

In some embodiments, the amorphous solid additionally comprises an active substance. For example, in some cases, the amorphous solid additionally comprises nicotine. In some cases, the amorphous solid may comprise 5-60 wt % (calculated on a dry weight basis) of an active substance. In some cases, the amorphous solid may comprise from about 1 wt %, 5 wt %, 10 wt %, 15 wt %, 20 wt % or 25 wt % to about 70 wt %, 60 wt %, 50 wt %, 45 wt %, 40 wt %, 35 wt %, or 30 wt % (calculated on a dry weight basis) of an active substance. In some cases, the amorphous solid may comprise from about 1 wt %, 2 wt %, 3 wt % or 4 wt % to about 20 wt %, 18 wt %, 15 wt % or 12 wt % (calculated on a dry weight basis) of nicotine. For example, the amorphous solid may comprise 1-20 wt %, 2-18 wt % or 3-12 wt % of nicotine.

In some cases, the amorphous solid comprises an active substance such as tobacco extract. In some cases, the amorphous solid may comprise 5-60 wt % (calculated on a dry weight basis) of tobacco extract. In some cases, the amorphous solid may comprise from about 5 wt %, 10 wt %, 15 wt %, 20 wt % or 25 wt % to about 60 wt %, 50 wt %, 45 wt %, 40 wt %, 35 wt %, or 30 wt % (calculated on a dry weight basis) tobacco extract. For example, the amorphous solid may comprise 10-50 wt %, 15-40 wt % or 20-35 wt % of tobacco extract. The tobacco extract may contain nicotine at a concentration such that the amorphous solid comprises 1 wt % 1.5 wt %, 2 wt % or 2.5 wt % to about 6 wt %, 5 wt %, 4.5 wt % or 4 wt % (calculated on a dry weight basis) of nicotine. In some cases, there may be no nicotine in the amorphous solid other than that which results from the tobacco extract.

In some embodiments, the active substance comprises one or more cannabinoid compounds selected from the group consisting of: cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM) and cannabielsoin (CBE), cannabicitran (CBT).

The active substance may comprise one or more cannabinoid compounds selected from the group consisting of cannabidiol (CBD) and THC (tetrahydrocannabinol).

The active substance may comprise cannabidiol (CBD).

The active substance may comprise nicotine and cannabidiol (CBD).

The active substance may comprise nicotine, cannabidiol (CBD), and THC (tetrahydrocannabinol).

In some embodiments the amorphous solid comprises no tobacco extract but does comprise nicotine. In some such cases, the amorphous solid may comprise from about 1 wt %, 2 wt %, 3 wt % or 4 wt % to about 20 wt %, 18 wt %, 15 wt % or 12 wt % (calculated on a dry weight basis) of nicotine. For example, the amorphous solid may comprise 1-20 wt %, 2-18 wt % or 3-12 wt % of nicotine.

In some cases, the total content of active substance and/or flavorant may be at least about 0.1 wt %, 1 wt %, 5 wt %, 10 wt %, 20 wt %, 25 wt % or 30 wt %. In some cases, the total content of active substance and/or flavorant may be less than about 70 wt %, 60 wt %, 50 wt % or 40 wt % (all calculated on a dry weight basis).

In some cases, the total content of particulate botanical material, nicotine and flavorant may be at least about 0.1 wt %, 1 wt %, 5 wt %, 10 wt %, 20 wt %, 25 wt % or 30 wt %. In some cases, the total content of particulate botanical material, nicotine and flavorant may be less than about 80 wt %, 70 wt %, 60 wt %, 50 wt % or 40 wt % (all calculated on a dry weight basis).

The amorphous solid may be made from a gel, and this gel may additionally comprise a solvent, included at 0.1-50 wt %. However, the inventors have established that the inclusion of a solvent in which the flavorant is soluble may reduce the gel stability and the flavorant may crystallize out of the gel. As such, in some cases, the gel does not include a solvent in which the flavorant is soluble.

Surprisingly, the inventors have identified that the use of molten menthol in a manufacturing process (as opposed to menthol in powder form) may reduce contamination of other machinery in the manufacturing location with menthol. In particular, providing menthol in molten form before combining at least some or all of the other components of the slurry may reduce contamination of other machinery (i.e. menthol is molten before all of the components in the slurry are combined). The use of molten menthol may also allow for improved dispersion of the menthol throughout the resulting amorphous solid, and/or providing material wherein more of the starting menthol present in the slurry is retained in the amorphous solid. Hence, in some embodiments the flavorant comprises molten menthol.

The inventors have also found that adding particulate botanical material to the amorphous solid (gel) results in an even suspension of botanical particles. When particulate tobacco material is included it contributes a natural tobacco taste to the aerosol generated by the resulting consumables. In some cases, the particulate tobacco is—at least for a fraction of the total tobacco powder amount—of the same size or below the size of the tobacco cell structure. Without wishing to be bound by theory, it is believed that fine grinding tobacco to about 0.05 millimeters can advantageously open the tobacco cell structure to improve aerosolization of, for example, tobacco flavor and nicotine. Examples of substances for which the aerosolization may be improved by providing tobacco powder with a mean powder size between about 0.03 millimeters and about 0.12 millimeters are pectin, nicotine, essential oils and other tobacco flavors. As used herein, the term "tobacco powder" indicates tobacco having a mean size between about 0.03 millimeters and about 0.12 millimeters. The slurry comprises a number of components to produce a homogenized tobacco containing aerosol-generating material. In some embodiments a component of the slurry is a particulate tobacco; this can also be referred to as a "tobacco powder"; suitably, the particulate tobacco represents the majority of the tobacco present in the slurry and provides a natural tobacco flavor.

To achieve a certain viscosity of slurry and moisture optimal for casting a web of homogenized amorphous solid, water may be added to the slurry.

Using finely ground particulate botanical material results in a very homogeneous slurry and then in a very homogeneous amorphous solid; however, the tensile strength of the amorphous solid obtained from this slurry may be relatively low and potentially insufficient to withstand the forces acting on the amorphous solid during processing. Advantageously, including a gelling agent improves the tensile strength of the amorphous solid. In some cases this means that fibers do not need to be added to increase the tensile strength of the amorphous solid. Furthermore, in some cases it will not be necessary to use a support, since the tensile strength is augmented by the gel. Without wishing to be bound by theory, it is also believed that dispersion of particulate botanical material, such as tobacco in a gel facilitates the release of aromatic components of the botanical material, when the final aerosol-generating material is used within non-combustible aerosol provision system.

A consistent mean size of the particulate botanical material between about 0.03 millimeters and about 0.12 millimeters may also improve the homogeneity of the slurry. If the botanical particles are too large, for example greater than about 0.15 millimeters, this may cause defects and weak areas in the amorphous solid which is formed from the slurry. Defects in the amorphous solid may reduce the tensile strength of the amorphous solid. A reduced tensile strength may lead to difficulties in subsequent handling of the amorphous solid in the production of the consumable and could for example cause machine stops. Additionally, an inhomogeneous amorphous solid may create unintended difference in the aerosol delivery between consumables that are produced from the same amorphous solid.

Therefore, a particulate botanical material having relatively small mean particle size is desired as a starting material to form the slurry to obtain acceptable amorphous solid for consumables of the invention. Too small botanical particles increases the energy consumption required in the process for their size reduction without adding advantages for this further reduction. A reduced particulate botanical mean size is also beneficial because it reduces the viscosity of the slurry, thereby allowing better homogeneity.

The amorphous solid may comprise a colorant. The addition of a colorant may alter the visual appearance of the amorphous solid. The presence of colorant in the amorphous solid may enhance the visual appearance of the amorphous solid and the aerosol-generating material. By adding a colorant to the amorphous solid, the amorphous solid may be color-matched to other components of the aerosol-generating material or to other components of an article comprising the amorphous solid.

A variety of colorants may be used depending on the desired color of the amorphous solid. The color of amorphous solid may be, for example, white, green, red, purple, blue, brown or black. Other colors are also envisaged. Natural or synthetic colorants, such as natural or synthetic dyes, food-grade colorants and pharmaceutical-grade colorants may be used. In certain embodiments, the colorant is caramel, which may confer the amorphous solid with a brown appearance. In such embodiments, the color of the amorphous solid may be similar to the color of other components (such as tobacco material) in an aerosol-generating material comprising the amorphous solid. In some embodiments, the addition of a colorant to the amorphous solid renders it visually indistinguishable from other components in the aerosol-generating material.

The colorant may be incorporated during the formation of the amorphous solid (e.g. when forming a slurry comprising the materials that form the amorphous solid) or it may be applied to the amorphous solid after its formation (e.g. by spraying it onto the amorphous solid).

In some cases, the amorphous solid comprises from 1-60 wt % of a filler, for example, 5-50 wt %, 10-40 wt % or 15-30 wt % of a filler. In some such cases the amorphous solid comprises at least 1 wt % of a filler, for example, at least 5 wt %, at least 10 wt %, at least 20 wt % at least 30 wt %, at least 40 wt %, or at least 50 wt % of a filler.

In some embodiments, the amorphous solid comprises less than 60 wt % of a filler, such as from 1 wt % to 60 wt %, or 5 wt % to 50 wt %, or 5 wt % to 30 wt %, or 10 wt % to 20 wt %.

In other embodiments, the amorphous solid comprises less than 20 wt %, suitably less than 10 wt % or less than 5 wt % of a filler. In some cases, the amorphous solid comprises less than 1 wt % of a filler, and in some cases, comprises no filler.

The filler, if present, may comprise one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. The filler may comprise one or more organic filler materials such as wood pulp, cellulose and cellulose derivatives (such as such as methylcellulose, hydroxypropyl cellulose, and carboxymethyl cellulose (CMC)). In particular cases, the amorphous solid comprises no calcium carbonate such as chalk.

In particular embodiments which include filler, the filler is fibrous. For example, the filler may be a fibrous organic filler material such as wood pulp, hemp fiber, cellulose or cellulose derivatives (such as such as methylcellulose, hydroxypropyl cellulose, and carboxymethyl cellulose (CMC)). Without wishing to be bound by theory, it is believed that including fibrous filler in an amorphous solid may increase the tensile strength of the material. This may be particularly advantageous in examples wherein the amorphous solid is provided as a sheet, such as when the sheet of amorphous solid circumscribes a rod of aerosol-generating material, or in cases where the sheet of amorphous solid is crimped and gathered to form a rod.

In some embodiments, the amorphous solid does not comprise tobacco fibers. In particular embodiments, the amorphous solid does not comprise fibrous material.

In some embodiments, the aerosol-generating material does not comprise tobacco fibers. In particular embodiments, the aerosol-generating material does not comprise fibrous material.

In some embodiments, the consumable does not comprise tobacco fibers. In particular embodiments, the consumable does not comprise fibrous material.

In some cases, the aerosol-generating material may have a thickness of about 0.015 mm to about 1.0 mm. Suitably, the thickness may be in the range of about 0.05 mm, 0.1 mm or 0.15 mm to about 0.5 mm or 0.3 mm. The inventors have found that a material having a thickness of 0.2 mm is particularly suitable. The aerosol-generating material may comprise more than one layer, and the thickness described herein refers to the aggregate thickness of those layers.

In some cases, the amorphous solid may have a thickness of about 0.015 mm to about 1.0 mm. Suitably, the thickness may be in the range of about 0.05 mm, 0.1 mm or 0.15 mm to about 0.5 mm or 0.3 mm. The inventors have found that a material having a thickness of 0.2 mm is particularly suitable. The amorphous solid may comprise more than one layer, and the thickness described herein refers to the aggregate thickness of those layers.

The inventors have established that if the aerosol-generating material or amorphous solid is too thick, then heating efficiency is compromised. This adversely affects the power consumption in use. Conversely, if the aerosol-generating material or amorphous solid is too thin, it is difficult to manufacture and handle; a very thin material is harder to cast and may be fragile, compromising aerosol formation in use.

The inventors have established that the aerosol-generating material or amorphous solid thicknesses stipulated herein optimize the material properties in view of these competing considerations.

The thickness stipulated herein is a mean thickness for the material. In some cases, the amorphous solid thickness may vary by no more than 25%, 20%, 15%, 10%, 5% or 1%.

In some examples, the amorphous solid in sheet form may have a tensile strength of from around 200 N/m to around 900 N/m. In some examples, such as where the amorphous solid does not comprise a filler, the amorphous solid may have a tensile strength of from 200 N/m to 400 N/m, or 200 N/m to 300 N/m, or about 250 N/m. Such tensile strengths may be particularly suitable for embodiments wherein the aerosol generating material is formed as a sheet and then shredded and incorporated into an aerosol generating consumable. In some examples, such as where the amorphous solid comprises a filler, the amorphous solid may have a tensile strength of from 600 N/m to 900 N/m, or from 700 N/m to 900 N/m, or around 800 N/m. Such tensile strengths may be particularly suitable for embodiments wherein the aerosol-generating material is included in an aerosol generating consumable/assembly as a rolled sheet, suitably in the form of a tube.

In some embodiments, the amorphous solid is formed as a sheet. In some cases, the amorphous solid sheet may be incorporated into the consumable in sheet form. The amorphous solid sheet may be incorporated as a planar sheet, as a gathered or bunched sheet, as a crimped sheet, or as a rolled sheet (i.e. in the form of a tube). In some such cases, the amorphous solid of these embodiments may be included in a consumable as a sheet, such as a sheet circumscribing a rod of aerosol-generating material (e.g. tobacco). For example, the amorphous solid sheet may be formed on a wrapping paper which circumscribes an aerosol-generating material such as tobacco. In other cases, the sheet may be shredded and then incorporated into the assembly, suitably mixed into an aerosol-generating material such as cut rag tobacco. In some cases, the amorphous solid may be incorporated into a pod or cartridge.

The amorphous solid may have any suitable area density, such as from 30 g/m$^2$ to 120 g/m$^2$. In some cases, the sheet may have a mass per unit area of 80-120 g/m$^2$, or from about 70 to 110 g/m$^2$, or particularly from about 90 to 110 g/m$^2$, or suitably about 100 g/m$^2$ (so that it has a similar density to cut rag tobacco and a mixture of these substances will not readily separate). Such area densities may be particularly suitable where the aerosol-generating material is included in an aerosol generating consumable/assembly in sheet form, or as a shredded sheet (described further hereinbelow). In some cases, the sheet may have a mass per unit area of about 30 to 70 g/m$^2$, 40 to 60 g/m$^2$, or 25-60 g/m$^2$ and may be used to wrap an aerosol-generating material such as tobacco.

A support may be provided to support the aerosol-generating material. The support functions as a support on which the amorphous solid layer forms, easing manufacture. The support may provide tensile strength to the amorphous solid, easing handling.

In some cases, the support may be formed from materials selected from metal foil, paper, carbon paper, greaseproof paper, ceramic, carbon allotropes such as graphite and graphene, plastic, cardboard, wood or combinations thereof. In some cases, the support may comprise or consist of a botanical material, such as a sheet of reconstituted tobacco. In some cases, the support may be formed from a susceptor material. In other cases the support may be formed from materials selected from metal foil, paper, cardboard, wood or combinations thereof. In some cases, the support itself be a laminate structure comprising layers of materials selected from the preceding lists. In some cases, the support may also function as a flavor carrier. For example, the carrier support may be impregnated with a flavorant or with tobacco extract.

In some cases, the support may be non-magnetic.

In some cases, the support may be magnetic. This functionality may be used to fasten the support to the assembly in use, or may be used to generate particular amorphous solid shapes. In some cases, the aerosol generating material may comprise one or more magnets which can be used to fasten the material to an induction heater in use.

In some cases, the support may be substantially or wholly impermeable to gas and/or aerosol. This prevents aerosol or gas passage through the carrier layer, thereby controlling the flow and ensuring it is delivered to the user. This can also be used to prevent condensation or other deposition of the gas/aerosol in use on, for example, the surface of a heater provided in an aerosol generating assembly. Thus, consumption efficiency and hygiene can be improved in some cases.

In some cases, the surface of the support that abuts the amorphous solid may be porous. For example, in one case, the support comprises paper. The inventors have found that a porous support such as paper is particularly suitable for the present invention; the porous (e.g. paper) layer abuts the amorphous solid layer and forms a strong bond. The amorphous solid is formed by drying a gel and, without being limited by theory, it is thought that the slurry from which the gel is formed partially impregnates the porous support (e.g. paper) so that when the gel sets and forms cross-links, the carrier support is partially bound into the gel. This provides a strong binding between the gel and the support (and between the dried gel and the carrier).

Additionally, surface roughness may contribute to the strength of bond between the amorphous solid and the support. The inventors have found that the paper roughness (for the surface abutting the carrier) may suitably be in the range of 50-1000 Bekk seconds, suitably 50-150 Bekk seconds, suitably 100 Bekk seconds (measured over an air pressure interval of 50.66-48.00 kPa). (A Bekk smoothness tester is an instrument used to determine the smoothness of a paper surface, in which air at a specified pressure is leaked between a smooth glass surface and a paper sample, and the time (in seconds) for a fixed volume of air to seep between these surfaces is the "Bekk smoothness".)

Conversely, the surface of the support facing away from the amorphous solid may be arranged in contact with the heater, and a smoother surface may provide more efficient heat transfer. Thus, in some cases, the support is disposed so as to have a rougher side abutting the amorphous solid and a smoother side facing away from the amorphous solid.

In one particular case, the support may be a paper-backed foil; the paper layer abuts the amorphous solid layer and the properties discussed in the previous paragraphs are afforded by this abutment. The foil backing is substantially impermeable, providing control of the aerosol flow path. A metal foil backing may also serve to conduct heat to the amorphous solid.

In another case, the foil layer of the paper-backed foil abuts the amorphous solid. The foil is substantially impermeable, thereby preventing water provided in the amorphous solid to be absorbed into the paper which could weaken its structural integrity.

In some cases, the support is formed from or comprises metal foil, such as aluminum foil. A metallic support may allow for better conduction of thermal energy to the amorphous solid. Additionally, or alternatively, a metal foil may function as a susceptor in an induction heating system. In particular embodiments, the support comprises a metal foil layer and a support layer, such as cardboard. In these embodiments, the metal foil layer may have a thickness of less than 20 μm, such as from about 1 μm to about 10 μm, suitably about 5 μm.

In some cases, the support may have a thickness of between about 0.010 mm and about 2.0 mm, suitably from about 0.015 mm, 0.02 mm, 0.05 mm or 0.1 mm to about 1.5 mm, 1.0 mm, or 0.5 mm.

Sheets of homogenized botanical material may be used as supports. The sheets of homogenized botanical material are suitably formed by a casting process, comprising casting a slurry comprising particulate botanical material and one or more binders onto a conveyor belt or other support surface, drying the cast slurry to form a sheet of homogenized botanical material and removing the sheet of homogenized botanical material from the support surface. In certain embodiments, the sheet of homogenized botanical material is wound into a bobbin.

In certain embodiments sheets of homogenized botanical material may be formed from slurry comprising particulate botanical material, guar gum, cellulose fibers and glycerol by a casting process. Such sheets of homogenized botanical material may be textured using suitable known machinery for texturing filter tow, paper and other materials. For example, sheets of homogenized botanical material for forming rods as described herein may be crimped using a crimping unit of the type described in CH-A-691156, which comprises a pair of rotatable crimping rollers. Sheets of homogenized botanical material may be textured using other suitable machinery and processes that deform or perforate the sheets of homogenized botanical material.

As used herein, the term 'crimped sheet' is intended to be synonymous with the term 'creped sheet' and denotes a sheet having a plurality of substantially parallel ridges or corrugations. Suitably, a crimped sheet of aerosol-generating material, has a plurality of ridges or corrugations substantially parallel to the cylindrical axis of the rod. This advantageously facilitates gathering of the crimped sheet of aerosol-generating material to form the rod. However, it will be appreciated that crimped sheets of aerosol-generating material or crimped sheets of amorphous solid for use in rods as described herein may alternatively or in addition have a plurality of substantially parallel ridges or corrugations disposed at an acute or obtuse angle to the cylindrical axis of the rod.

In certain embodiments, sheets of aerosol-generating material for use in consumables as described herein may be substantially evenly textured over substantially their entire surface. For example, crimped sheets of aerosol-generating material or crimped sheets of amorphous solid for use in rods as described herein may comprise a plurality of substantially parallel ridges or corrugations that are substantially evenly spaced-apart across the width of the sheet.

Sheets of amorphous solid or aerosol-generating material may be textured using suitable known machinery for texturing filter tow, paper and other materials. For example, sheets of aerosol-generating material for forming rods as described herein may be crimped using a crimping unit of the type described in CH-A-691156, which comprises a pair of rotatable crimping rollers. However, it will be appreciated that sheets of amorphous solid or aerosol-generating material may be textured using other suitable machinery and processes that deform or perforate the sheets of amorphous solid or aerosol-generating material.

In some embodiments the amorphous solid may be formed by casing the slurry on a support which is moveable along a transport direction. In some embodiments, the slurry is cast by means of the cast apparatus across the width of a moving transporting support. For example, the casting may take place by means of a casting blade. The transporting support moves along a longitudinal or transport direction in order to remove the slurry from the cast apparatus. The support may include for example a stainless-steel movable belt. The cast apparatus is suitably designed and construed to form a cast slurry which has a substantially uniform thickness onto the movable support.

The cast homogenized tobacco sheet has a width, which is defined as its dimension substantially perpendicular to the transport direction of the movable support, which is preferably determined by a compromise between production speed and drying speed. Preferably, the moisture of the sheet needs to be kept substantially uniform and controlled in order to obtain an end product with a limited number of defects, and in addition there is a need to obtain a production rate as high as possible. A proper moisture control would reduce a selected value for the width of the sheet, because a relatively "small width" permits greater uniformity of moisture content; in particular, during a drying step, however the production rate can be increased when the sheet is relatively wide. Therefore, preferably the width of the sheet is as wide as a proper control of its moisture content allows.

Consumable and Non-Combustible Aerosol Provision System

As used herein, the term "delivery system" is intended to encompass systems that deliver a substance to a user, and includes:

- combustible aerosol provision systems, such as cigarettes, cigarillos, cigars, and tobacco for pipes or for roll-your-own or for make-your-own cigarettes (whether based on tobacco, tobacco derivatives, expanded tobacco, reconstituted tobacco, tobacco substitutes or other smokable material);
- non-combustible aerosol provision systems that release compounds from an aerosol-generating material without combusting the aerosol-generating material, such as electronic cigarettes, tobacco heating products, and hybrid systems to generate aerosol using a combination of aerosol-generating materials;
- consumables comprising aerosol-generating material and configured to be used within one of these non-combustible aerosol provision systems; and
- aerosol-free delivery systems which deliver one or more substances to a user orally, nasally, transdermally or in another way without forming an aerosol, including but not limited to, lozenges, gums, patches, consumables comprising inhalable powders, and oral products such as oral tobacco which includes snus or moist snuff, wherein the substance may or may not comprise nicotine.

According to the present disclosure, a "combustible" aerosol provision system is one where a constituent aerosol-generating material of the aerosol provision system (or component thereof) is combusted or burned during use in order to facilitate delivery to a user.

According to the present disclosure, a "non-combustible" aerosol provision system is one where a constituent aerosol-generating material of the aerosol provision system (or component thereof) is not combusted or burned in order to facilitate delivery to a user.

In some embodiments, the delivery system is a combustible aerosol provision system, selected from the group consisting of a cigarette, a cigarillo and a cigar.

In some embodiments, the disclosure relates to a component for use in a combustible aerosol provision systems, such as a filter, a filter rod, a filter segment, a tobacco rod, a spill, an additive release component such as a capsule, a thread, or a bead, or a paper such as a plug wrap, a tipping paper or a cigarette paper.

In some embodiments, the delivery system is a non-combustible aerosol provision system, such as a powered non-combustible aerosol provision system.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is a tobacco heating system, also known as a heat-not-burn system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product.

Typically, the non-combustible aerosol provision system may comprise a non-combustible aerosol provision device and a consumable for use with the non-combustible aerosol provision device. However, it is envisaged that consumables which themselves comprise a means for powering an aerosol generating component may themselves form the non-combustible aerosol provision system.

In some embodiments, the non-combustible aerosol provision device may comprise a power source and a controller. The power source may, for example, be an electric power source or an exothermic power source. In some embodiments, the exothermic power source comprises a carbon substrate which may be energized so as to distribute power in the form of heat to an aerosol-generating material or heat transfer material in proximity to the exothermic power source. In some embodiments, the power source, such as an exothermic power source, is provided in the consumable so as to form the non-combustible aerosol provision.

In some embodiments, the consumable for use with the non-combustible aerosol provision device may comprise an aerosol-generating material, an aerosol generating component, an aerosol generating area, a mouthpiece, and/or an area for receiving aerosol-generating material.

In some embodiments, the aerosol generating component is a heater capable of interacting with the aerosol-generating material so as to release one or more volatiles from the aerosol-generating material to form an aerosol. In some embodiments, the aerosol generating component is capable of generating an aerosol from the aerosol-generating material without heating. For example, the aerosol generating component may be capable of generating an aerosol from the aerosol-generating material without applying heat thereto, for example via one or more of vibrational, mechanical, pressurization or electrostatic means.

The consumable may alternatively be referred to herein as a cartridge. The consumable may be adapted for use in a THP, a hybrid device or another aerosol generating device. In some cases, the consumable may additionally comprise a filter and/or cooling element, as described previously. In some cases, the consumable may be circumscribed by a wrapping material such as paper.

The consumable of the invention may additionally comprise ventilation apertures. These may be provided in the sidewall of the consumable. In some cases, the ventilation apertures may be provided in the filter and/or cooling element. These apertures may allow cool air to be drawn into the consumable during use, which can mix with the heated volatilized components thereby cooling the aerosol.

The ventilation enhances the generation of visible heated volatilized components from the consumable when it is heated in use. The heated volatilized components are made visible by the process of cooling the heated volatilized components such that supersaturation of the heated volatilized components occurs. The heated volatilized components then undergo droplet formation, otherwise known as nucleation, and eventually the size of the aerosol particles of the heated volatilized components increases by further condensation of the heated volatilized components and by coagulation of newly formed droplets from the heated volatilized components.

In some cases, the ratio of the cool air to the sum of the heated volatilized components and the cool air, known as the ventilation ratio, is at least 15%. A ventilation ratio of 15% enables the heated volatilized components to be made visible by the method described above. The visibility of the heated volatilized components enables the user to identify that the volatilized components have been generated and adds to the sensory experience of the smoking experience.

In another example, the ventilation ratio is between 50% and 85% to provide additional cooling to the heated volatilized components. In some cases, the ventilation ratio may be at least 60% or 65%.

Figure 2:
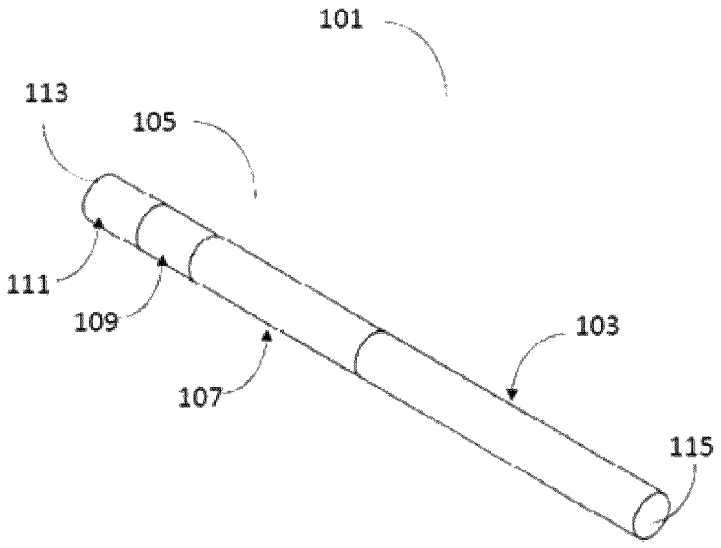
FIG. 2 shows a perspective view of the consumable of FIG. 1.

Referring to FIGS. 1 and 2, there are shown a partially cut-away section view and a perspective view of an example of an aerosol-generating consumable 101. The consumable 101 is adapted for use with a device having a power source and a heater. The consumable 101 of this embodiment is particularly suitable for use with the device 51 shown in FIGS. 5 to 7, described below. In use, the consumable 101 may be removably inserted into the device shown in FIG. 5 at an insertion point 20 of the device 51.

The consumable 101 of one example is in the form of a substantially cylindrical rod that includes a body of aerosol-generating material 103 and a filter assembly 105 in the form of a rod. The aerosol-generating material comprises the amorphous solid material described herein. In some embodiments, it may be included in sheet form. In some embodiments it may be included in the form of a shredded sheet. In some embodiments, the aerosol-generating material described herein may be incorporated in sheet form and in shredded form.

The filter assembly 105 includes three segments, a cooling segment 107, a filter segment 109 and a mouth end segment 111. The consumable 101 has a first end 113, also known as a mouth end or a proximal end and a second end 115, also known as a distal end. The body of aerosol-generating material 103 is located towards the distal end 115 of the consumable 101. In one example, the cooling segment 107 is located adjacent the body of aerosol-generating material 103 between the body of aerosol generating material 103 and the filter segment 109, such that the cooling segment 107 is in an abutting relationship with the aerosol-generating material 103 and the filter segment 103. In other examples, there may be a separation between the body of aerosol-generating material 103 and the cooling segment 107 and between the body of aerosol-generating material 103 and the filter segment 109. The filter segment 109 is located in between the cooling segment 107 and the mouth end segment 111. The mouth end segment 111 is located towards the proximal end 113 of the consumable 101, adjacent the filter segment 109. In one example, the filter segment 109 is in an abutting relationship with the mouth end segment 111. In one embodiment, the total length of the filter assembly 105 is between 37 mm and 45 mm, more preferably, the total length of the filter assembly 105 is 41 mm.

In one example, the rod of aerosol-generating material 103 is between 34 mm and 50 mm in length, suitably between 38 mm and 46 mm in length, suitably 42 mm in length.

In one example, the total length of the consumable 101 is between 71 mm and 95 mm, suitably between 79 mm and 87 mm, suitably 83 mm.

An axial end of the body of aerosol-generating material 103 is visible at the distal end 115 of the consumable 101. However, in other embodiments, the distal end 115 of the consumable 101 may comprise an end member (not shown) covering the axial end of the body of aerosol-generating material 103.

The body of aerosol-generating material 103 is joined to the filter assembly 105 by annular tipping paper (not shown), which is located substantially around the circumference of the filter assembly 105 to surround the filter assembly 105 and extends partially along the length of the body of aerosol-generating material 103. In one example, the tipping paper is made of 58GSM standard tipping base paper. In one example the tipping paper has a length of between 42 mm and 50 mm, suitably of 46 mm.

In one example, the cooling segment 107 is an annular tube and is located around and defines an air gap within the cooling segment. The air gap provides a chamber for heated volatilized components generated from the body of aerosol-generating material 103 to flow. The cooling segment 107 is hollow to provide a chamber for aerosol accumulation yet rigid enough to withstand axial compressive forces and bending moments that might arise during manufacture and whilst the consumable 101 is in use during insertion into the device 51. In one example, the thickness of the wall of the cooling segment 107 is approximately 0.29 mm.

The cooling segment 107 provides a physical displacement between the aerosol-generating material 103 and the filter segment 109. The physical displacement provided by the cooling segment 107 will provide a thermal gradient across the length of the cooling segment 107. In one example the cooling segment 107 is configured to provide a temperature differential of at least 40 degrees Celsius between a heated volatilized component entering a first end of the cooling segment 107 and a heated volatilized component exiting a second end of the cooling segment 107. In one example the cooling segment 107 is configured to provide a temperature differential of at least 60 degrees Celsius between a heated volatilized component entering a first end of the cooling segment 107 and a heated volatilized component exiting a second end of the cooling segment 107. This temperature differential across the length of the cooling element 107 protects the temperature sensitive filter segment 109 from the high temperatures of the aerosol-generating material 103 when it is heated by the device 51. If the physical displacement was not provided between the filter segment 109 and the body of aerosol-generating material 103 and the heating elements of the device 51, then the temperature sensitive filter segment may 109 become damaged in use, so it would not perform its required functions as effectively.

In one example the length of the cooling segment 107 is at least 15 mm. In one example, the length of the cooling segment 107 is between 20 mm and 30 mm, more particularly 23 mm to 27 mm, more particularly 25 mm to 27 mm, suitably 25 mm.

The cooling segment 107 is made of paper, which means that it is comprised of a material that does not generate compounds of concern, for example, toxic compounds when in use adjacent to the heater of the device 51. In one example, the cooling segment 107 is manufactured from a spirally wound paper tube which provides a hollow internal chamber yet maintains mechanical rigidity. Spirally wound paper tubes are able to meet the tight dimensional accuracy requirements of high-speed manufacturing processes with respect to tube length, outer diameter, roundness and straightness.

In another example, the cooling segment 107 is a recess created from stiff plug wrap or tipping paper. The stiff plug wrap or tipping paper is manufactured to have a rigidity that is sufficient to withstand the axial compressive forces and bending moments that might arise during manufacture and whilst the consumable 101 is in use during insertion into the device 51.

The filter segment 109 may be formed of any filter material sufficient to remove one or more volatilized compounds from heated volatilized components from the aerosol-generating material. In one example the filter segment 109 is made of a mono-acetate material, such as cellulose acetate. The filter segment 109 provides cooling and irritation-reduction from the heated volatilized components without depleting the quantity of the heated volatilized components to an unsatisfactory level for a user.

In some embodiments, a capsule (not illustrated) may be provided in filter segment 109. It may be disposed substantially centrally in the filter segment 109, both across the filter segment 109 diameter and along the filter segment 109 length. In other cases, it may be offset in one or more dimension. The capsule may in some cases, where present, contain a volatile component such as a flavorant or aerosol generating agent.

The density of the cellulose acetate tow material of the filter segment 109 controls the pressure drop across the filter segment 109, which in turn controls the draw resistance of the consumable 101. Therefore, the selection of the material of the filter segment 109 is important in controlling the resistance to draw of the consumable 101. In addition, the filter segment performs a filtration function in the consumable 101.

In one example, the filter segment 109 is made of a 8Y15 grade of filter tow material, which provides a filtration effect on the heated volatilized material, whilst also reducing the size of condensed aerosol droplets which result from the heated volatilized material.

The presence of the filter segment 109 provides an insulating effect by providing further cooling to the heated volatilized components that exit the cooling segment 107. This further cooling effect reduces the contact temperature of the user's lips on the surface of the filter segment 109.

In one example, the filter segment 109 is between 6 mm to 10 mm in length, suitably 8 mm.

The mouth end segment 111 is an annular tube and is located around and defines an air gap within the mouth end segment 111. The air gap provides a chamber for heated volatilized components that flow from the filter segment 109. The mouth end segment 111 is hollow to provide a chamber for aerosol accumulation yet rigid enough to withstand axial compressive forces and bending moments that might arise during manufacture and whilst the consumable is in use during insertion into the device 51. In one example, the thickness of the wall of the mouth end segment 111 is approximately 0.29 mm. In one example, the length of the mouth end segment 111 is between 6 mm to 10 mm, suitably 8 mm.

The mouth end segment 111 may be manufactured from a spirally wound paper tube which provides a hollow internal chamber yet maintains critical mechanical rigidity. Spirally wound paper tubes are able to meet the tight dimensional accuracy requirements of high-speed manufacturing processes with respect to tube length, outer diameter, roundness and straightness.

The mouth end segment 111 provides the function of preventing any liquid condensate that accumulates at the exit of the filter segment 109 from coming into direct contact with a user.

It should be appreciated that, in one example, the mouth end segment 111 and the cooling segment 107 may be formed of a single tube and the filter segment 109 is located within that tube separating the mouth end segment 111 and the cooling segment 107.

Figure 3:
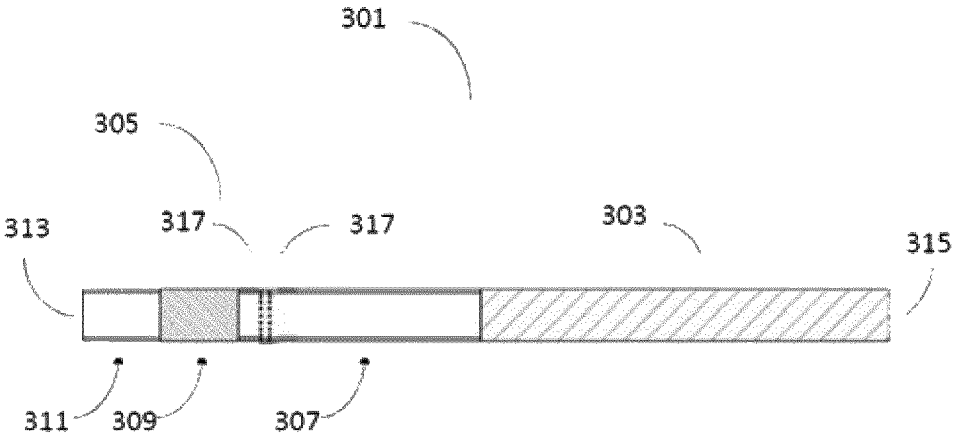
FIG. 3 shows a sectional elevation of an example of a consumable.
Figure 4:
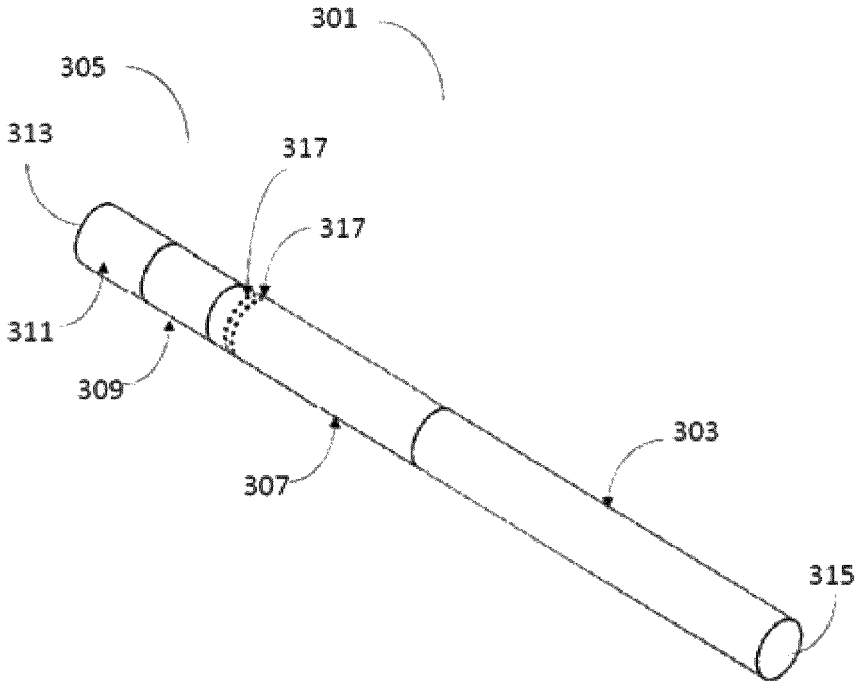
FIG. 4 shows a perspective view of the consumable of FIG. 3.

Referring to FIGS. 3 and 4, there are shown a partially cut-away section and perspective views of an example of an consumable 301. The reference signs shown in FIGS. 3 and 4 are equivalent to the reference signs shown in FIGS. 1 and 2, but with an increment of 200.

In the example of the consumable 301 shown in FIGS. 3 and 4, a ventilation region 317 is provided in the consumable 301 to enable air to flow into the interior of the consumable 301 from the exterior of the consumable 301. In one example the ventilation region 317 takes the form of one or more ventilation holes 317 formed through the outer layer of the consumable 301. The ventilation holes may be located in the cooling segment 307 to aid with the cooling of the consumable 301. In one example, the ventilation region 317 comprises one or more rows of holes, and preferably, each row of holes is arranged circumferentially around the consumable 301 in a cross-section that is substantially perpendicular to a longitudinal axis of the consumable 301.

In one example, there are between one to four rows of ventilation holes to provide ventilation for the consumable 301. Each row of ventilation holes may have between 12 to 36 ventilation holes 317. The ventilation holes 317 may, for example, be between 100 to 500 μm in diameter. In one example, an axial separation between rows of ventilation holes 317 is between 0.25 mm and 0.75 mm, suitably 0.5 mm.

In one example, the ventilation holes 317 are of uniform size. In another example, the ventilation holes 317 vary in size. The ventilation holes can be made using any suitable technique, for example, one or more of the following techniques: laser technology, mechanical perforation of the cooling segment 307 or pre-perforation of the cooling segment 307 before it is formed into the consumable 301. The ventilation holes 317 are positioned so as to provide effective cooling to the consumable 301.

In one example, the rows of ventilation holes 317 are located at least 11 mm from the proximal end 313 of the consumable, suitably between 17 mm and 20 mm from the proximal end 313 of the consumable 301. The location of the ventilation holes 317 is positioned such that user does not block the ventilation holes 317 when the consumable 301 is in use.

Figure 6:
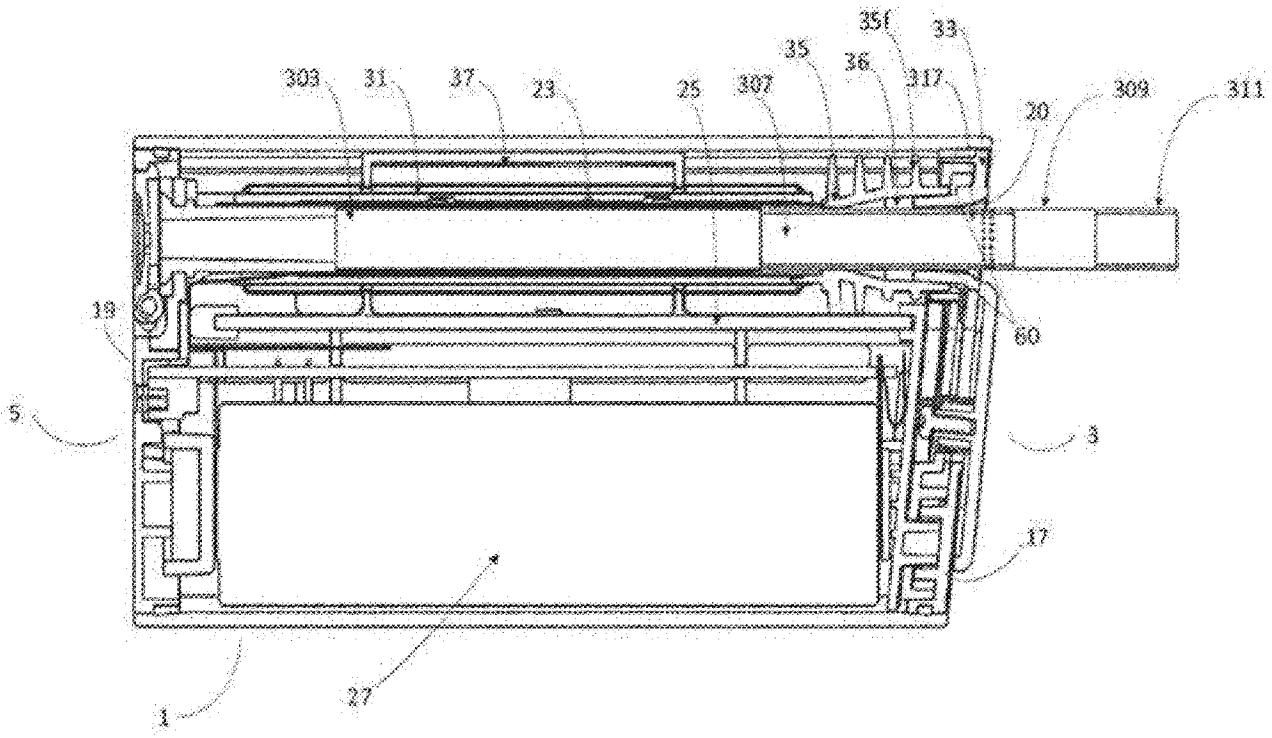
FIG. 6 shows a section view of an example of a non-combustible aerosol provision system.
Figure 7:
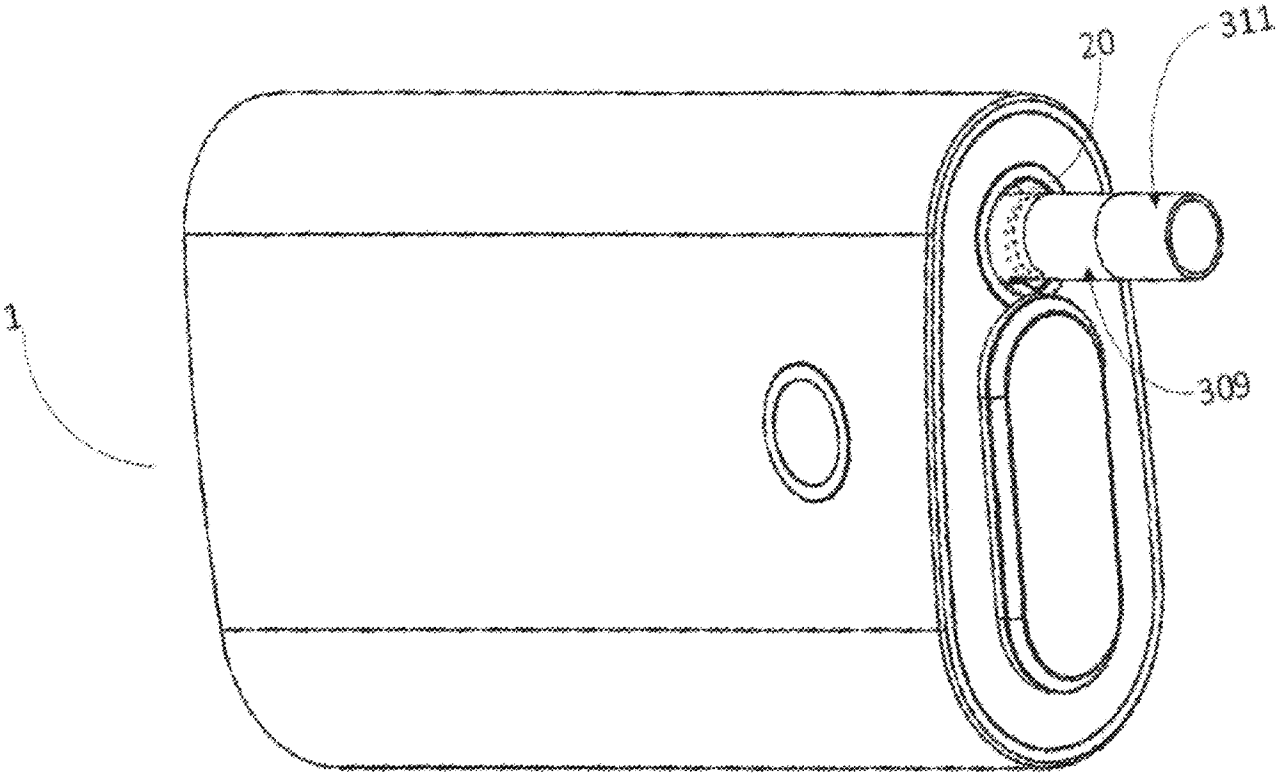
FIG. 7 shows a perspective view of an example of a non-combustible aerosol provision system.

Providing the rows of ventilation holes between 17 mm and 20 mm from the proximal end 313 of the consumable 301 enables the ventilation holes 317 to be located outside of the device 51, when the consumable 301 is fully inserted in the device 51, as can be seen in FIGS. 6 and 7. By locating the ventilation holes outside of the device, non-heated air is able to enter the consumable 301 through the ventilation holes from outside the device 51 to aid with the cooling of the consumable 301.

The length of the cooling segment 307 is such that the cooling segment 307 will be partially inserted into the device 51, when the consumable 301 is fully inserted into the device 51. The length of the cooling segment 307 provides a first function of providing a physical gap between the heater arrangement of the device 51 and the heat sensitive filter arrangement 309, and a second function of enabling the ventilation holes 317 to be located in the cooling segment, whilst also being located outside of the device 51, when the consumable 301 is fully inserted into the device 51. As can be seen from FIGS. 6 and 7, the majority of the cooling element 307 is located within the device 51. However, there is a portion of the cooling element 307 that extends out of the device 51. It is in this portion of the cooling element 307 that extends out of the device 51 in which the ventilation holes 317 are located.

Figure 5:
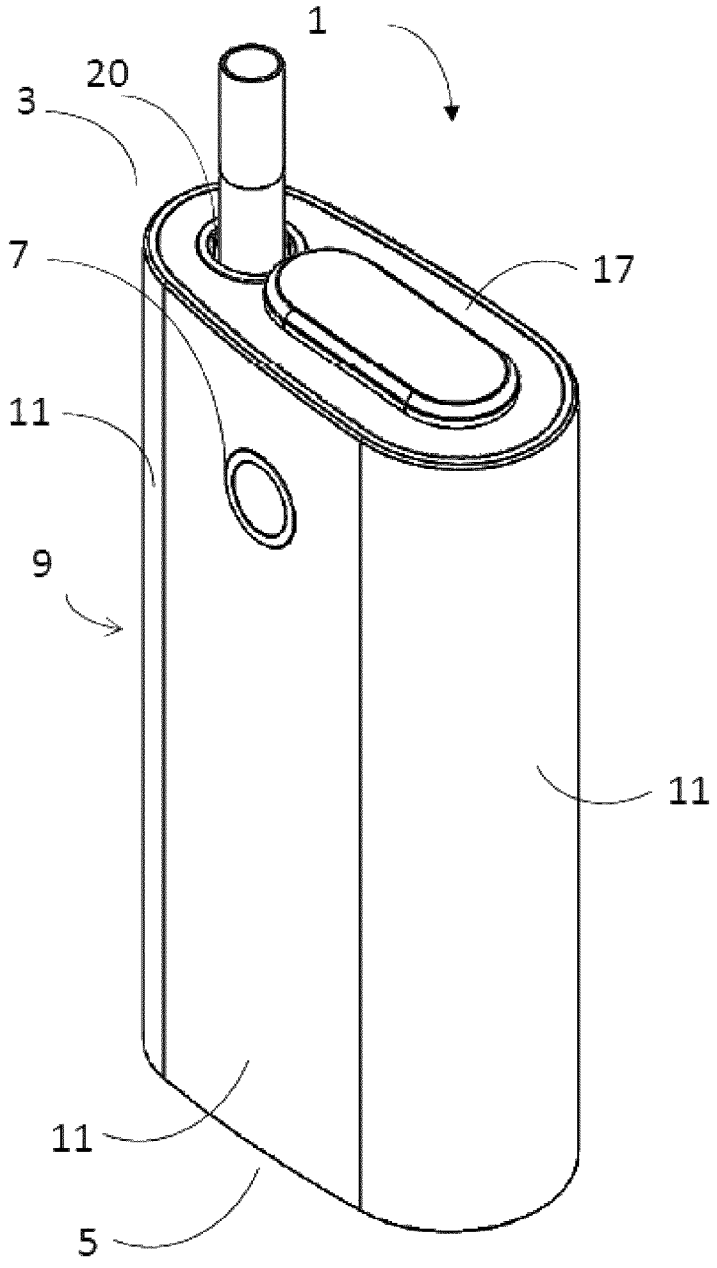
FIG. 5 shows a perspective view of an example of a non-combustible aerosol provision system.

Referring now to FIGS. 5 to 7 in more detail, there is shown an example of a device 51 arranged to heat aerosol-generating material to volatilize at least one component of said aerosol-generating material, typically to form an aerosol which can be inhaled. The device 51 is a heating device which releases compounds by heating, but not burning, the aerosol-generating material.

A first end 53 is sometimes referred to herein as the mouth or proximal end 53 of the device 51 and a second end 55 is sometimes referred to herein as the distal end 55 of the device 51. The device 51 has an on/off button 57 to allow the device 51 as a whole to be switched on and off as desired by a user.

The device 51 comprises a housing 59 for locating and protecting various internal components of the device 51. In the example shown, the housing 59 comprises a uni-body sleeve 11 that encompasses the perimeter of the device 51, capped with a top panel 17 which defines generally the 'top' of the device 51 and a bottom panel 19 which defines generally the 'bottom' of the device 51. In another example the housing comprises a front panel, a rear panel and a pair of opposite side panels in addition to the top panel 17 and the bottom panel 19.

The top panel 17 and/or the bottom panel 19 may be removably fixed to the uni-body sleeve 11, to permit easy access to the interior of the device 51, or may be "permanently" fixed to the uni-body sleeve 11, for example to deter a user from accessing the interior of the device 51. In an example, the panels 17 and 19 are made of a plastics material, including for example glass-filled nylon formed by injection molding, and the uni-body sleeve 11 is made of aluminum, though other materials and other manufacturing processes may be used.

The top panel 17 of the device 51 has an opening 20 at the mouth end 53 of the device 51 through which, in use, the consumable 101, 301 including the aerosol-generating material may be inserted into the device 51 and removed from the device 51 by a user.

The housing 59 has located or fixed therein a heater arrangement 23, control circuitry 25 and a power source 27. In this example, the heater arrangement 23, the control circuitry 25 and the power source 27 are laterally adjacent (that is, adjacent when viewed from an end), with the control circuitry 25 being located generally between the heater arrangement 23 and the power source 27, though other locations are possible.

The control circuitry 25 may include a controller, such as a microprocessor arrangement, configured and arranged to control the heating of the aerosol-generating material in the consumable 101, 301 as discussed further below.

The power source 27 may be for example a battery, which may be a rechargeable battery or a non-rechargeable battery. Examples of suitable batteries include for example a lithium-ion battery, a nickel battery (such as a nickel-cadmium battery), an alkaline battery and/or the like. The battery 27 is electrically coupled to the heater arrangement 23 to supply electrical power when required and under control of the control circuitry 25 to heat the aerosol-generating material in the consumable (as discussed, to volatilize the aerosol-generating material without causing the aerosol-generating material to burn).

An advantage of locating the power source 27 laterally adjacent to the heater arrangement 23 is that a physically large power source 25 may be used without causing the device 51 as a whole to be unduly lengthy. As will be understood, in general a physically large power source 25 has a higher capacity (that is, the total electrical energy that can be supplied, often measured in Amp-hours or the like) and thus the battery life for the device 51 can be longer.

In one example, the heater arrangement 23 is generally in the form of a hollow cylindrical tube, having a hollow interior heating chamber 29 into which the consumable 101, 301 comprising the aerosol-generating material is inserted for heating in use. Different arrangements for the heater arrangement 23 are possible. For example, the heater arrangement 23 may comprise a single heating element or may be formed of plural heating elements aligned along the longitudinal axis of the heater arrangement 23. The or each heating element may be annular or tubular, or at least part-annular or part-tubular around its circumference. In an example, the or each heating element may be a thin film heater. In another example, the or each heating element may be made of a ceramics material. Examples of suitable ceramics materials include alumina and aluminum nitride and silicon nitride ceramics, which may be laminated and sintered. Other heating arrangements are possible, including for example inductive heating, infrared heater elements, which heat by emitting infrared radiation, or resistive heating elements formed by for example a resistive electrical winding.

In one particular example, the heater arrangement 23 is supported by a stainless steel support tube and comprises a polyimide heating element. The heater arrangement 23 is dimensioned so that substantially the whole of the body of aerosol-generating material 103, 303 of the consumable 101, 301 is inserted into the heater arrangement 23 when the consumable 101, 301 is inserted into the device 51.

The or each heating element may be arranged so that selected zones of the aerosol-generating material can be independently heated, for example in turn (over time, as discussed above) or together (simultaneously) as desired.

The heater arrangement 23 in this example is surrounded along at least part of its length by a thermal insulator 31. The insulator 31 helps to reduce heat passing from the heater arrangement 23 to the exterior of the device 51. This helps to keep down the power requirements for the heater arrangement 23 as it reduces heat losses generally. The insulator 31 also helps to keep the exterior of the device 51 cool during operation of the heater arrangement 23. In one example, the insulator 31 may be a double-walled sleeve which provides a low pressure region between the two walls of the sleeve. That is, the insulator 31 may be for example a "vacuum" tube, i.e. a tube that has been at least partially evacuated so as to minimize heat transfer by conduction and/or convection. Other arrangements for the insulator 31 are possible, including using heat insulating materials, including for example a suitable foam-type material, in addition to or instead of a double-walled sleeve.

The housing 59 may further comprises various internal support structures 37 for supporting all internal components, as well as the heating arrangement 23.

The device 51 further comprises a collar 33 which extends around and projects from the opening 20 into the interior of the housing 59 and a generally tubular chamber 35 which is located between the collar 33 and one end of the vacuum sleeve 31. The chamber 35 further comprises a cooling structure **35*f*, which in this example, comprises a plurality of cooling fins 35*f* spaced apart along the outer surface of the chamber 35, and each arranged circumferentially around outer surface of the chamber 35. There is an air gap 36 between the hollow chamber 35 and the consumable 101, 301 when it is inserted in the device 51 over at least part of the length of the hollow chamber 35. The air gap 36 is around all of the circumference of the consumable 101, 301 over at least part of the cooling segment 307**.

The collar 33 comprises a plurality of ridges 60 arranged circumferentially around the periphery of the opening 20 and which project into the opening 20. The ridges 60 take up space within the opening 20 such that the open span of the opening 20 at the locations of the ridges 60 is less than the open span of the opening 20 at the locations without the ridges 60. The ridges 60 are configured to engage with an consumable 101, 301 inserted into the device to assist in securing it within the device 51. Open spaces (not shown in the Figures) defined by adjacent pairs of ridges 60 and the consumable 101, 301 form ventilation paths around the exterior of the consumable 101, 301. These ventilation paths allow hot vapors that have escaped from the consumable 101, 301 to exit the device 51 and allow cooling air to flow into the device 51 around the consumable 101, 301 in the air gap 36.

In operation, the consumable 101, 301 is removably inserted into an insertion point 20 of the device 51, as shown in FIGS. 5 to 7. Referring particularly to FIG. 6, in one example, the body of aerosol-generating material 103, 303, which is located towards the distal end 115, 315 of the consumable 101, 301, is entirely received within the heater arrangement 23 of the device 51. The proximal end 113, 313 of the consumable 101, 301 extends from the device 51 and acts as a mouthpiece assembly for a user.

In operation, the heater arrangement 23 will heat the consumable 101, 301 to volatilize at least one component of the aerosol-generating material from the body of aerosol-generating material 103, 303.

The primary flow path for the heated volatilized components from the body of aerosol-generating material 103, 303 is axially through the consumable 101, 301, through the chamber inside the cooling segment 107, 307, through the filter segment 109, 309, through the mouth end segment 111, 313 to the user. In one example, the temperature of the heated volatilized components that are generated from the body of aerosol generating material is between 60° C. and 250° C., which may be above the acceptable inhalation temperature for a user. As the heated volatilized component travels through the cooling segment 107, 307, it will cool and some volatilized components will condense on the inner surface of the cooling segment 107, 307.

In the examples of the consumable 301 shown in FIGS. 3 and 4, cool air will be able to enter the cooling segment 307 via the ventilation holes 317 formed in the cooling segment 307. This cool air will mix with the heated volatilized components to provide additional cooling to the heated volatilized components.

Definitions

Active Substance

In some embodiments, the substance to be delivered comprises an active substance.

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, *cannabis* or another botanical.

In some embodiments, the active substance comprises nicotine. In some embodiments, the active substance comprises caffeine, melatonin or vitamin B12.

In some embodiments, the aerosol-generating material comprises one or more cannabinoid compounds selected from the group consisting of: cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM) and cannabielsoin (CBE), cannabicitran (CBT).

The aerosol-generating material may comprise one or more cannabinoid compounds selected from the group consisting of cannabidiol (CBD) and THC (tetrahydrocannabinol).

The aerosol-generating material may comprise cannabidiol (CBD).

The aerosol-generating material may comprise nicotine and cannabidiol (CBD).

The aerosol-generating material may comprise nicotine, cannabidiol (CBD), and THC (tetrahydrocannabinol).

Botanicals

As noted herein, the active substance may comprise or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, *eucalyptus*, star anise, hemp, cocoa, *cannabis*, fennel, lemongrass, peppermint, spearmint, rooibos, chamomile, flax, ginger, *Ginkgo biloba*, hazel, hibiscus, laurel, licorice (liquorice), matcha, mate, orange skin, *papaya*, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, *curcuma*, turmeric, sandalwood, cilantro, bergamot, orange blossom, myrtle, cassis, valerian, pimento, mace, damien, marjoram, olive, lemon balm, lemon basil, chive, *carvi, verbena*, tarragon, *geranium*, mulberry, *ginseng*, theanine, theacrine, maca, ashwagandha, damiana, *guarana*, chlorophyll, *baobab* or any combination thereof. The mint may be chosen from the following mint varieties: *Mentha Arventis, Mentha* c.v., *Mentha niliaca, Mentha piperita, Mentha piperita* citrata c.v., *Mentha piperita* c.v, *Mentha spicata* crispa, *Mentha* cardifolia, *Memtha longifolia, Mentha suaveolens* variegata, *Mentha pulegium, Mentha spicata* c.v. and *Mentha suaveolens*

In some embodiments, the active substance comprises or is derived from one or more botanicals or constituents, derivatives or extracts thereof and the botanical is tobacco.

In some embodiments, the active substance comprises or derived from one or more botanicals or constituents, derivatives or extracts thereof and the botanical is selected from *eucalyptus*, star anise, cocoa and hemp.

In some embodiments, the active substance comprises or derived from one or more botanicals or constituents, derivatives or extracts thereof and the botanical is selected from rooibos and fennel.

Flavors

In some embodiments, the substance to be delivered comprises a flavor.

As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, *cannabis*, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, *papaya*, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, *geranium*, khat, naswar, betel, shisha, pine, honey essence, rose oil, vanilla, lemon oil, orange oil, orange blossom, cherry blossom, *cassia*, caraway, cognac, jasmine, ylang-ylang, sage, fennel, wasabi, piment, ginger, coriander, coffee, hemp, a mint oil from any species of the genus *Mentha, eucalyptus*, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, *curcuma*, cilantro, myrtle, cassis, valerian, pimento, mace, damien, marjoram, olive, lemon balm, lemon basil, chive, *carvi, verbena*, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from *cannabis*.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

Aerosol-Generating Material

Aerosol-generating material is a material that is capable of generating aerosol, for example when heated, irradiated or energized in any other way. Aerosol-generating material may, for example, be in the form of a solid, liquid or gel which may or may not contain an active substance and/or flavorants. In some embodiments, the aerosol-generating material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material may for example comprise from about 50 wt %, 60 wt % or 70 wt % of amorphous solid, to about 90 wt %, 95 wt % or 100 wt % of amorphous solid.

The aerosol-generating material may comprise one or more active substances and/or flavors, one or more aerosol-former materials, and optionally one or more other functional material.

Aerosol-Former Material

The aerosol-former material may comprise one or more constituents capable of forming an aerosol. In some embodiments, the aerosol-former material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

In some embodiments, the aerosol former comprises one or more polyhydric alcohols, such as propylene glycol, triethylene glycol, 1,3-butanediol and glycerin; esters of polyhydric alcohols, such as glycerol mono-, di- or triacetate; and/or aliphatic esters of mono-, di- or polycarboxylic acids, such as dimethyl dodecanedioate and dimethyl tetradecanedioate.

Functional Material

The one or more other functional materials may comprise one or more of pH regulators, coloring agents, preservatives, binders, fillers, stabilizers, and/or antioxidants.

Acid

The aerosol-generating material or amorphous solid may comprise an acid. The acid may be an organic acid. In some of these embodiments, the acid may be at least one of a monoprotic acid, a diprotic acid and a triprotic acid. In some such embodiments, the acid may contain at least one carboxyl functional group. In some such embodiments, the acid may be at least one of an alpha-hydroxy acid, carboxylic acid, dicarboxylic acid, tricarboxylic acid and keto acid. In some such embodiments, the acid may be an alpha-keto acid.

In some such embodiments, the acid may be at least one of succinic acid, lactic acid, benzoic acid, citric acid, tartaric acid, fumaric acid, levulinic acid, acetic acid, malic acid, formic acid, sorbic acid, benzoic acid, propanoic and pyruvic acid.

Suitably the acid is lactic acid. In other embodiments, the acid is benzoic acid. In other embodiments the acid may be an inorganic acid. In some of these embodiments the acid may be a mineral acid. In some such embodiments, the acid may be at least one of sulphuric acid, hydrochloric acid, boric acid and phosphoric acid. In some embodiments, the acid is levulinic acid.

The inclusion of an acid is particularly preferred in embodiments in which the aerosol-generating material comprises nicotine. In such embodiments, the presence of an acid may stabilize dissolved species in the slurry from which the aerosol-generating material is formed. The presence of the acid may reduce or substantially prevent evaporation of nicotine during drying of the slurry, thereby reducing loss of nicotine during manufacturing.

In certain embodiments, the aerosol-generating material or amorphous solid comprises a gelling agent comprising a cellulosic gelling agent and/or a non-cellulosic gelling agent, an active substance and an acid.

Substrate

The material may be present on or in a support, to form a substrate. The support may, for example, be or comprise paper, card, paperboard, cardboard, reconstituted material, a plastics material, a ceramic material, a composite material, glass, a metal, or a metal alloy. In some embodiments, the support comprises a susceptor. In some embodiments, the susceptor is embedded within the material. In some alternative embodiments, the susceptor is on one or either side of the material.

Consumable

A consumable is an article comprising or consisting of aerosol-generating material, part or all of which is intended to be consumed during use by a user. A consumable may comprise one or more other components, such as an aerosol-generating material storage area, an aerosol-generating material transfer component, an aerosol generation area, a housing, a wrapper, a mouthpiece, a filter and/or an aerosol-modifying agent. A consumable may also comprise an aerosol generator, such as a heater, that emits heat to cause the aerosol-generating material to generate aerosol in use. The heater may, for example, comprise combustible material, a material heatable by electrical conduction, or a susceptor.

Susceptor

A susceptor is a material that is heatable by penetration with a varying magnetic field, such as an alternating magnetic field. The susceptor may be an electrically-conductive material, so that penetration thereof with a varying magnetic field causes induction heating of the heating material.

The heating material may be magnetic material, so that penetration thereof with a varying magnetic field causes magnetic hysteresis heating of the heating material. The susceptor may be both electrically-conductive and magnetic, so that the susceptor is heatable by both heating mechanisms. The device that is configured to generate the varying magnetic field is referred to as a magnetic field generator, herein.

Aerosol Generator

An aerosol generator is an apparatus configured to cause aerosol to be generated from the aerosol-generating material. In some embodiments, the aerosol generator is a heater configured to subject the aerosol-generating material to heat energy, so as to release one or more volatiles from the aerosol-generating material to form an aerosol. In some embodiments, the aerosol generator is configured to cause an aerosol to be generated from the aerosol-generating material without heating. For example, the aerosol generator may be configured to subject the aerosol-generating material to one or more of vibration, increased pressure, or electrostatic energy.

All percentages by weight described herein (denoted wt %) are calculated on a dry weight basis, unless explicitly stated otherwise. All weight ratios are also calculated on a dry weight basis. A weight quoted on a dry weight basis refers to the whole of the extract or slurry or material, other than the water, and may include components which by themselves are liquid at room temperature and pressure, such as glycerol. Conversely, a weight percentage quoted on a wet weight basis refers to all components, including water.

For the avoidance of doubt, where in this specification the term "comprises" is used in defining the invention or features of the invention, embodiments are also disclosed in which the invention or feature can be defined using the terms "consists essentially of" or "consists of" in place of "comprises". Reference to a material "comprising" certain features means that those features are included in, contained in, or held within the material.

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A method of manufacturing an amorphous solid, the method comprising:

a) forming a slurry comprising a particulate botanical material, a gelling agent and an aerosol-former material;

b) forming a layer of the slurry; and c) drying the slurry to provide the amorphous solid, wherein the forming the layer of the slurry comprises forming the layer of the slurry on a support comprising a susceptor material.

2. The method according to claim 1, comprising casting the slurry formed on a support movable along a transport direction.

3. The method according to claim 1, wherein the amorphous solid is in the form of a sheet.

4. The method according to claim 3, further comprising:

d) slitting the sheet along the transport direction while the sheet is moved along the transport direction so as to form portioned sheets of the amorphous solid.

5. The method according to claim 3, comprising winding the sheet onto a bobbin.

6. The method according to claim 1, wherein the slurry comprises a filler wherein the filler comprises one or more of wood pulp, cellulose, or derivatives thereof.

7. The method according to claim 1, wherein the susceptor material comprises aluminium foil.

8. The method according to claim 1, comprising crimping the amorphous solid.

9. The method according to claim 1, comprising:

d) gathering the amorphous solid into a rod and circumscribing the rod with a wrapper to form a consumable for use within a non-combustible aerosol provision system.

10. The method according to claim 1, wherein the drying the slurry comprises drying the slurry to provide a sheet of the amorphous solid; and wherein the method comprises;

d) crimping the sheet to form a crimped sheet; and e) gathering the crimped sheet.

11. An amorphous solid obtainable or obtained by a method according to claim 1.

12. A consumable for use within a non-combustible aerosol provision system, the consumable comprising an aerosol-generating material comprising an amorphous solid, the amorphous solid comprising:

30-60 wt % of an active substance comprising particulate botanical material, 1-50 wt % of a gelling agent, and 0.1-50 wt % of an aerosol-former;

wherein these wt % are calculated on a dry weight basis.

13. The consumable of claim 12, wherein the amorphous solid is in the form of a sheet.

14. A non-combustible aerosol provision system comprising a consumable according to claim 12 and a non-combustible aerosol provision device, the non-combustible aerosol provision device comprising an aerosol-generation device to generate aerosol from the consumable when the consumable is used with the non-combustible aerosol provision device.

15. A method of use of a consumable as described in claim 12 in a non-combustible aerosol provision device, the non-combustible aerosol provision device comprising an aerosol-generation device to generate aerosol from the consumable when the consumable is used with the non-combustible aerosol provision device.

* * * * *